US006378531B1

(12) United States Patent
Marquis

(10) Patent No.: US 6,378,531 B1
(45) Date of Patent: Apr. 30, 2002

(54) METHOD OF PROVIDING BODY IN HAIR USING BENT HAIR CLIP

(76) Inventor: Jacquelyn Marquis, 119 Davies Rd., Saskatoon, Saskatchewan (CA), S7K 7L3

( * ) Notice: Subject to any disclaimer, the term of this patent is extended or adjusted under 35 U.S.C. 154(b) by 0 days.

(21) Appl. No.: 09/754,166

(22) Filed: Jan. 4, 2001

(51) Int. Cl.[7] ..... A45D 7/00
(52) U.S. Cl. ..... 132/210; 132/277
(58) Field of Search ..... 132/276, 277, 132/278, 279, 207; D28/40; 24/507, 521, 571

(56) References Cited

U.S. PATENT DOCUMENTS 2,160,346 A * 5/1939 Valentine ..... 132/277
2,765,487 A * 10/1956 Foster ..... 16/404
2,883,993 A * 4/1959 Laughton ..... 132/277
3,968,806 A * 7/1976 Altemare ..... 132/277
5,101,842 A * 4/1992 Ehmann ..... 132/210
6,209,549 B1 * 4/2001 Lunde ..... 132/207

FOREIGN PATENT DOCUMENTS

AU 142418 * 7/1951 ..... 132/277

* cited by examiner

*Primary Examiner*—Todd E. Manahan
*Assistant Examiner*—David Comstock
(74) *Attorney, Agent, or Firm*—Patterson, Thuente, Skaar & Christensen, P.A.

(57) ABSTRACT

A method comprising gathering and holding a portion of wet hair adjacent to roots thereof in a clip adjacent to a scalp and maintaining the portion of hair substantially upright with respect to the scalp while the hair dries. The clip for hair comprises a pair of bars pivotally attached to each other at pivot ends thereof with opposing inner surfaces of the bars closely adjacent or bearing against each other along a substantial length thereof when in a closed position. A bias force acts to maintain the bars in the closed position and the bars are movable against the bias force to an open position. Means are provided to maintain the inner surfaces of the bars in a substantially upright orientation with respect to a scalp when grasping hair between the inner surfaces adjacent to roots of the hair.

3 Claims, 3 Drawing Sheets

METHOD OF PROVIDING BODY IN HAIR USING BENT HAIR CLIP

This invention is in the field of hair care and in particular devices for use when drying hair to provide body in a finished hair style.

BACKGROUND

"Body" is a term used in hair styling to describe the fullness and spring of a person's hair. Hair that has no body is commonly referred to as being "flat" as it lays close to the scalp, while hair with body springs away from the scalp.

Hair that dries against the scalp tends to remain flat after it dries. Conventionally body is provided by wrapping the hair around a plurality of rollers while it dries. The rollers hold the hair away from the scalp, so that when the rollers are removed, the hair is "springy". The hair may then be further styled, curled, and so forth.

Many different types of rollers are available, in various diameters, and the rollers may be clipped in some cases, or are maintained by friction or other means. This rolling involves locating the free ends of a portion of the hair, wrapping the ends around the roller, and rotating the roller to accumulate the hair on the roller right down to the root portion adjacent to the scalp. The roller essentially rests on the scalp and holds the hair off the scalp, and provides body.

The rolling process is time consuming, and must be done every day by people with longer hair, such as is most common with people of the female gender.

SUMMARY OF THE INVENTION

It is the object of the present invention to provide a device for holding hair off the scalp while it dries, thereby providing body to the hair, the device being much quicker to put in place than conventional devices.

It is a further object of the invention to provide such a device that is a clip, similar to conventional flat bar clips, that is bent such that when clipped on a root portion of hair adjacent to the scalp, the clip does not fall over as is the case with conventional clips.

It is a further object of the invention to provide a method of providing body while drying hair that is quicker to use The invention provides, in one aspect, a clip for hair comprising: a pair of bars pivotally attached to each other at pivot ends thereof about an axis, with opposing inner surfaces of the bars closely adjacent or bearing against each other along a substantial length thereof when in a closed position, the bars bent such that a distal portion of the bars forms an angle with a proximate portion of the bars, the proximate portion adjacent the pivot ends of the bars; a lever arm extending from each pivot end beyond the axis and away from each other when in the closed position, the lever arms biased into the closed position and movable towards each other against a bias force to an open position wherein the bars are separated; wherein the angle is sufficient to maintain the inner surfaces of the bars in a substantially upright orientation with respect to a scalp when grasping hair between the inner surfaces adjacent to roots of the hair.

The invention provides, in a second aspect, a method of providing body while drying hair, the method comprising gathering and holding a portion of wet hair adjacent to roots thereof in a clip adjacent to a scalp and maintaining the portion of hair substantially upright with respect to the scalp while the hair dries.

The invention provides, in a third aspect, a clip for hair comprising a pair of bars pivotally attached to each other at pivot ends thereof about an axis, with opposing inner surfaces of the bars closely adjacent or bearing against each other along a substantial length thereof when in a closed position; a bias force acting to maintain the bars in the closed position, the bars movable against the bias force to an open position wherein the bars are separated to allow a portion of hair to be positioned between them; means to maintain the inner surfaces of the bars in a substantially upright orientation with respect to a scalp when grasping hair between the inner surfaces adjacent to roots of the hair.

Instead of falling over, as would a conventional clip, the disclosed clip of the invention instead stands up on edge supported by distal and proximate portions forming an angle with each other. The hair is thus maintained in an upright orientation, off the scalp, so that it dries with body.

Alternatively the lever arms which are used to open the clip could be extended sufficiently to maintain the clip upright. It is contemplated that the bent bars would be preferred in most cases, since the extended lever arms would act only to support the clip upright, while the bent bars perform that function ands also grasp the hair, therefore providing a larger function for a given amount of material.

The method disclosed is much quicker than conventional roller methods, as the work is done at the root end of the hair, adjacent to the scalp. Conventional body providing methods require that the free ends of a suitable portion of hair be located and wrapped around the roller, and the roller then must be rotated to gather the distal, intermediate and root portions of the hair onto the roller for drying. In some cases the roller must then additionally be clipped into place.

In the disclosed method, only the root portion of the hair next to the scalp must be addressed, with the bent clips being inserted into the hair near the scalp in an open position, then released to grasp the hair and hold it off the scalp. It is not critical that every hair be grasped, as the adjacent upright portions of hair that are grasped act to prevent free hairs from laying against the scalp. Similarly, distal and intermediate portions of hair may be caught in the clip without significantly interfering with the method.

It can be seen that the method is quicker to practice than conventional roller methods.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
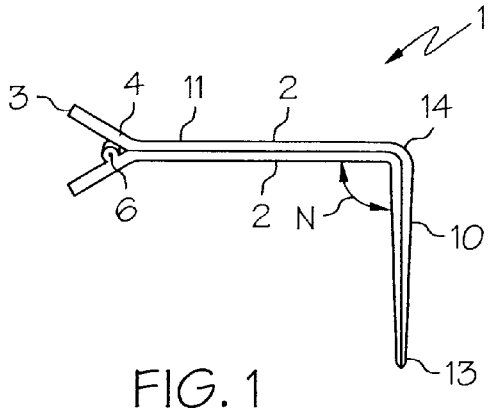
FIG. 1 is a top view of an embodiment of the invention in the closed position.

FIGS. 1–4 illustrate a clip 1 for hair comprising a pair of bars 2 pivotally attached to each other at pivot ends 4 thereof about an axis 6. Opposing inner surfaces 8 of the bars 2 are closely adjacent or bearing against each other along a substantial length thereof when in the closed position illustrated in FIG. 1.

Figure 2:
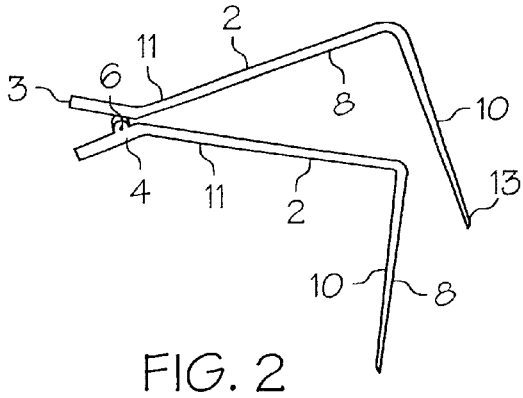
FIG. 2 is a top view of the embodiment of FIG. 1 in the open position.

A lever arm 3 extends from each pivot end 4 beyond the axis 6 and away from each other when in the closed position of FIG. 1. The lever arms 3 are biased into the closed position and movable towards each other against a bias force to an open position, such as is illustrated in FIG. 2., wherein the bars 2 are separated. The bias force is provided by a coil spring wrapped about the pivot axis 6 as in conventional clips and is not further illustrated.

Means are provided to maintain the inner surfaces 8 of the bars 2 in a substantially upright orientation with respect to a scalp when grasping hair between the inner surfaces 8 adjacent to roots of the hair. The hair is thus held off the scalp while it dries and thus has body when dry.

In the embodiments of FIGS. 1–7, this means is provided by bending the bars 2. The bars 2 are bent such that distal portions 10 of the bars form an angle N with proximate portions 11 of the bars 2 adjacent the pivot ends 4 thereof. The angle N is sufficient to maintain the inner surfaces 8 of the bars 2 in a substantially upright orientation with respect to a scalp when grasping hair between the inner surfaces 8 adjacent to roots of the hair.

Figure 9:
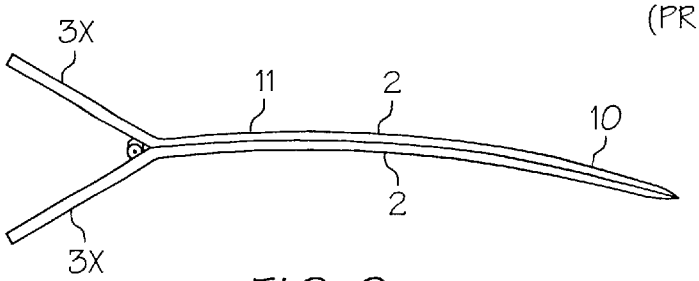
FIG. 9 is a top view of an embodiment of the invention with extended lever arms.

In the embodiment of FIG. 9 the means to maintain the inner surfaces 8 upright comprises extended lever arms 3X. As can be seen from the illustration, the extended lever arms 3X are sufficiently long to maintain the clip 1 in an upright orientation. The extended lever arms 3X are not as easy to manipulate as the shorter conventional lever arms of FIGS. 1–7, and get in the way of other clips 1 when being placed into position.

Figure 8:
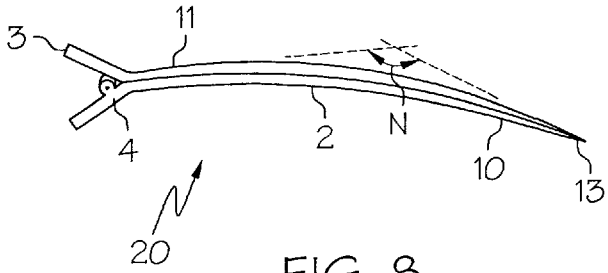
FIG. 8 (PRIOR ART)
FIG. 8 is a top view of a prior art clip.

A prior art clip 20 is illustrated in FIG. 8. This clip 20 will not consistently stay upright as will the clip 1 of the present invention. The weight of longer hair especially pulls them over.

Figure 5:
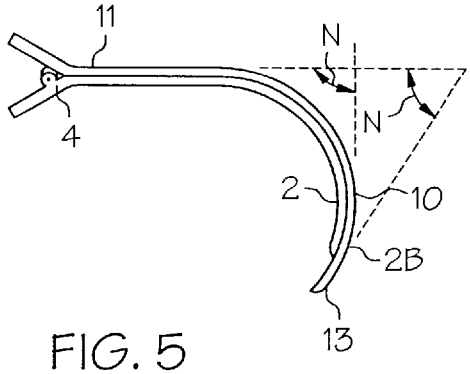
FIG. 5 is a top view of an alternate arced embodiment of the invention.

Each of the pair of bars 2 illustrated has a substantially equal length, except for those of FIG. 5 where one bar 2B has a length that is greater than a length of the other of the pair of bars 2B.

Various bends will suffice to support the clip 1 in an upright orientation. In the clip 1 of FIG. 5 the inner surfaces form an arc between free ends 13 of the bars 2 and pivot ends 4 thereof. In the clip 1 of FIGS. 1, 6, and 7 the inner surfaces 8 form a corner 14, substantially parallel to the axis 6, between the distal and proximate portions 10, 11. The corner 14 is rounded to avoid any sharp edges.

The angle N is conveniently between 45 degrees and 135 degrees, and commonly will be between 70 degrees and 110 degrees. In the prior art clip 20 of FIG. 8, the angle N is between 150 and 180 degrees, either straight or slightly bowed as illustrated.

Figure 6:
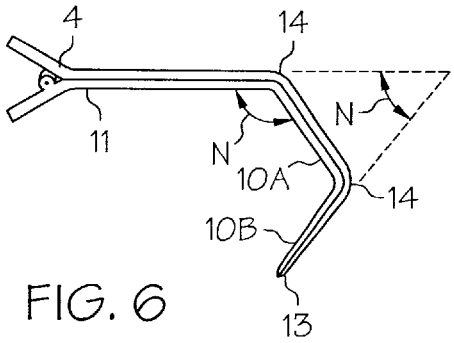
FIG. 6 is a top view of an embodiment of the invention having two corners.
Figure 7:
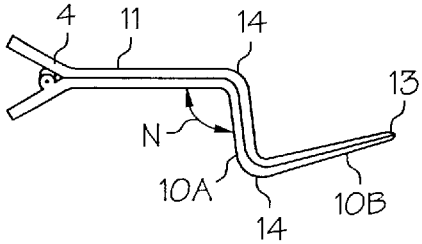
FIG. 7 is a top view of an embodiment of the invention having two reverse corners.

The clips 1 of FIGS. 6 and 7 have two distinct distal portions 10A, 10B, such that two corners 14 are formed. Such a clip 1 could be advantageous with some hair types. Other configurations could perform the function of maintaining the clip 1 in an upright orientation as well.

Those skilled in the art will realize that for embodiment such as those of FIGS. 1, 6, and 7 the angle N must be such that the clip 1 will open. Where the angle N is much less than 90 degrees, the upper bar 2 will contact the lower bar 2 and not be able to open. In the embodiment of FIG. 6 however the angle N between the proximate portion 11 and second distal portion 10B can be much less than 90 degrees. The person skilled in the art will recognize the inherent limitations present with various embodiments.

Figure 3:
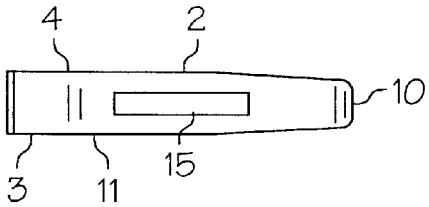
FIG. 3 is a front view of the embodiment of FIG. 1 in the closed position.
Figure 4:
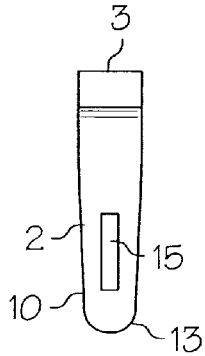
FIG. 4 is a side view of the embodiment of FIG. 1 in the closed position.

The bars 2, as illustrated in FIGS. 3 and 4 can taper from a wider width at the pivot end 4 to a narrower width at the free end 13. Also as illustrated in FIGS. 3 and 4 the bars 2 are pierced by apertures 15 which save material and weight, and do not interfere with the utility of the clip 1.

Figure 10:
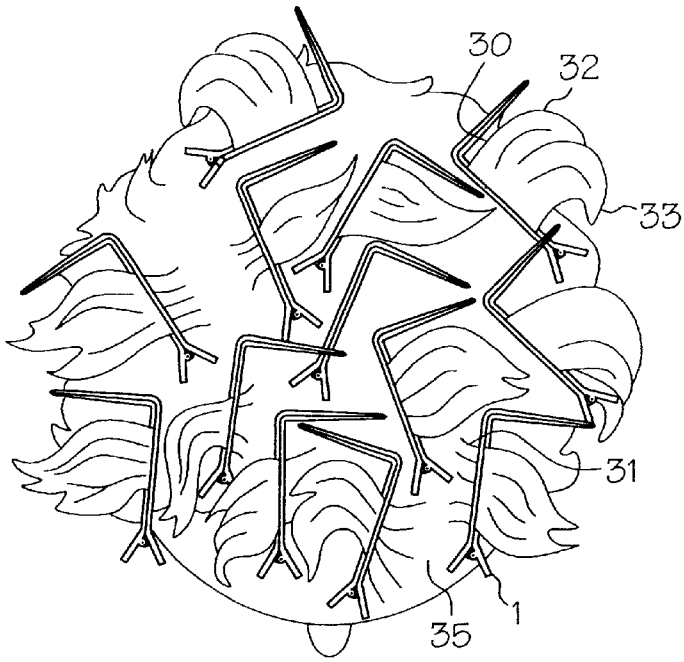
FIG. 10 is front view of a plurality of clips of the invention in place in a head of hair.
Figure 11:
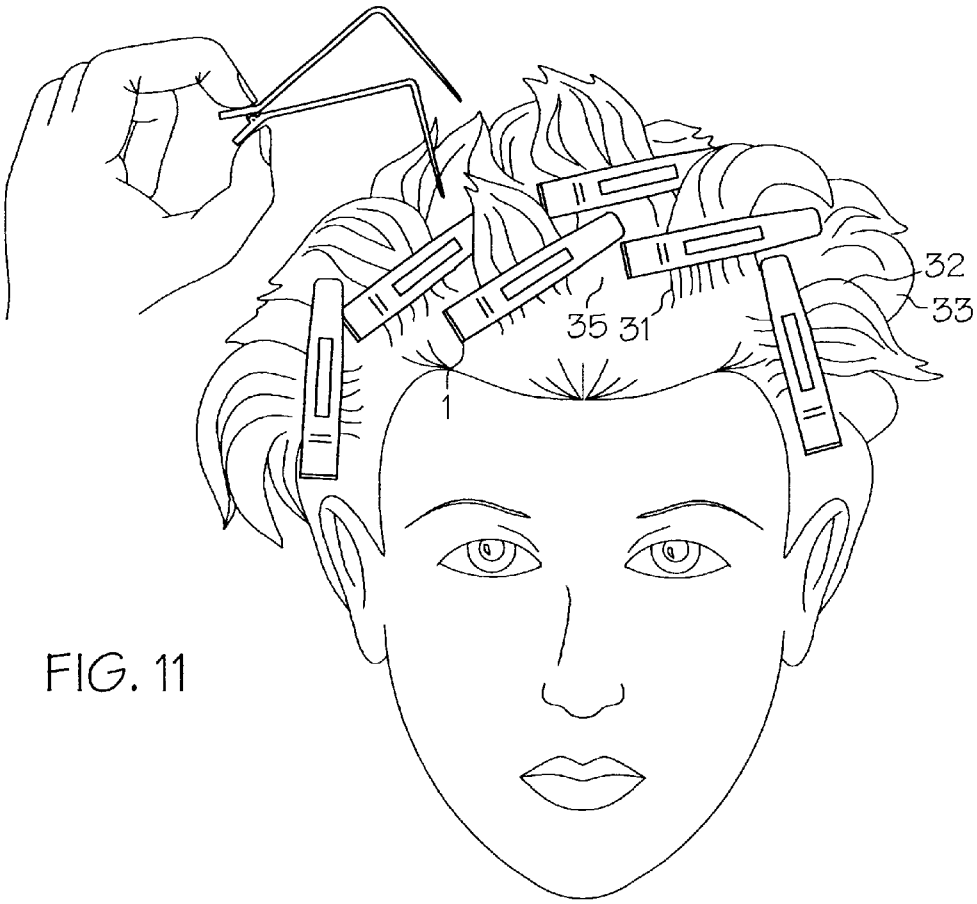
FIG. 11 is a top view of the clips and hair of FIG. 10.

As illustrated in FIGS. 10 and 11, the method comprises gathering and holding a root portion 31 of wet hair 30 adjacent to roots thereof in a clip 1 adjacent to a scalp 35 and maintaining the root portion 31 of hair 30 substantially upright with respect to the scalp 35 while the hair 30 dries. End 33 and intermediate 32 portions of hair 30 can be clipped as well without interfering with the method. This will usually occur when the method is used, as great care is not required to place the clips 1, and such hair portions 32, 33 will sometimes be clipped as well.

End 33 and intermediate 32 portions of longer hair 30 can be gathered and stacked as well by hooking the distal ends 10 of the clips 1 in previously placed clips 1 adjacent the scalp 35. The longer hair can then dry. Clips 1 can be decorated and left in the hair as well to form hairstyles.

The clips 1 may be placed much quicker than rollers, and provide dry hair with body that can be styled in a manner similar to hair dried in rollers.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A method of providing body while drying hair, the method comprising:

gathering and holding a root portion of wet hair adjacent to roots thereof in lower bent clips adjacent to a scalp;

maintaining the root portion of hair substantially upright with respect to the scalp while the hair dries;

gathering and holding intermediate and end portions of wet hair in upper bent clips;

wherein the upper and lower bent clips comprise a pair of bars pivotally attached to each other at pivot ends thereof about an axis, with opposing inner surfaces of the bars closely adjacent or bearing against each other along a substantial length thereof when in a closed position, the bars bent such that a distal portion of the bars forms an angle with a proximate portion of the bars, the proximate portion adjacent the pivot ends of the bars;

securing the upper bent clips in place by hooking the distal ends thereof into engagement with the lower bent clips.

2. The method of claim 1 further comprising leaving the upper and lower bent clips in the hair.

3. The method of claim 2 further comprising decorating the upper and lower bent clips.

* * * * *